United States Patent [19]

Roberts

[11] 4,245,747

[45] Jan. 20, 1981

[54] COUPLER

[75] Inventor: Leslie N. Roberts, Columbus, Ohio

[73] Assignee: Buckeye International, Inc., Columbus, Ohio

[21] Appl. No.: 845,803

[22] Filed: Oct. 27, 1977

Related U.S. Application Data

[63] Continuation of Ser. No. 595,766, Jul. 14, 1975, abandoned.

[51] Int. Cl.[2] ..... B61G 5/04; B61G 7/14

[52] U.S. Cl. ..... 213/153

[58] Field of Search ..... 213/153

[56] References Cited

U.S. PATENT DOCUMENTS

| | | | |
|---|---|---|---|
| 2,719,634 | 10/1955 | Metzger | 213/153 |
| 2,772,791 | 12/1956 | Wolfe | 213/153 X |
| 3,637,089 | 1/1972 | Jwuc et al. | 213/153 |

*Primary Examiner*—F. J. Bartuska
*Attorney, Agent, or Firm*—Charles F. Pigott, Jr.

[57] ABSTRACT

An improved type "E" railway coupler with a top and bottom shelf is provided for reducing the possibility of derailments of railroad cars caused by accidental disengagement of interlocking couplers. The improved coupler has a top planar surface for fixedly carrying the top shelf and has a bottom planar surface for fixedly carrying the bottom shelf. The top shelf includes an upper abutment surface limiting the upward vertical movement of a mating coupler and has a set of downwardly-extending coplanar pads seated upon the top planar surface. The bottom shelf includes a lower abutment surface limiting the bottom vertical movement of a mating coupler and has a set of upwardly-extending coplanar pads positioned against the bottom planar surface.

4 Claims, 10 Drawing Figures

COUPLER

This is a continuation of application Ser. No. 595,766, filed July 14, 1975, now abandoned.

BACKGROUND OF THE INVENTION

This invention relates to railway couplers, and more particularly, to an improved type "E" coupler, with a top and bottom shelf.

In the past, there have been several serious wrecks on railroads involving tank cars with standard American Association of Railroads (AAR) type "E" couplers. In some cases the tank cars have carried hazardous materials which have exploded during the wreck causing loss of property and lives. During normal movement of railroad cars, the standard type "E" coupler will ride up and down on a mating coupler. The United States Department of Transportation, however, has claimed that during derailment the standard type "E" coupler will ride up and over the mating coupler and puncture the tank car.

Because the standard type "E" coupler has provided many decades of useful service for American railroads, attempts have been made to modify the "E" coupler to prevent the coupler from riding up and over its mating coupler during movement of the cars. The standard "E" coupler has been modified to include an integral top shelf and/or bottom shelf. The shelves limit the vertical movement of the mating coupler. Unfortunately, a standard "E" coupler with integral top and bottom shelves is not universally adaptable when top and bottom shelves are not wanted or considered necessary for other types of railway usage not involving tank cars carrying hazardous material.

Separable top and bottom shelves have been manufactured and selectively welded to the standard "E" coupler for use with tank cars carrying hazardous materials. Such separable shelves permit use of the standard "E" coupler without the shelves for railway usage not involving tank cars carrying hazardous materials. The separable cast top and bottom shelves are contoured to fit the existing standard "E" coupler. Unfortunately, however, it is very difficult and expensive to hold the dimensional tolerances required for such a contoured casting.

SUMMARY OF THE INVENTION

It is an object of this invention to provide an improved coupler assembly which lessens the risk of derailments and tank car wrecks.

Another object of the invention is to provide an improved coupler unit which will prevent a mating coupler associated therewith from slipping out of engagement when forces tend to create excessive relative vertical movement between the two couplers.

Another object of this invention is to provide a modified "E" coupler with a substantially flat top and bottom surface to which top and bottom shelves may be attached with a minimum of difficulty.

A further object of this invention is to provide improved top and bottom shelves which avoid the problem of contoured casting tolerances.

It is still another object of this invention to simplify the design and construction of both the top and bottom shelves so as to reduce manufacturing costs without sacrificing the safety features of the shelves.

There is provided by virtue of this invention a railway coupler assembly for preventing derailments during interlocking engagement with a second coupler. The coupler assembly includes an improved type "E" coupler, a top shelf and a bottom shelf.

The improved type "E" coupler includes upper-shelf rib means defining a flat top planar surface and lower-shelf rib means defining a flat bottom planar surface. Means are included with the improved type "E" coupler for interlocking engagement with the second coupler.

The top shelf shaped to define a first hood has a set of coplanar downward-extending pads which are secured to the flat top surface of the improved coupler. The first hood covers the top planar surface and prevents the second coupler from moving above the top shelf during interlocking engagement.

The bottom shelf shaped to define a second hood has a set of coplanar upward-extending pads secured to the flat bottom surface of the coupler. The second hood covers the bottom planar surface and prevents the second coupler from moving below the bottom shelf during interlocking engagement with the improved coupler.

The foregoing and other objects and advantages will be apparent from the following description and appended claims, taken in conjunction with the accompanying drawings.

DETAILED DESCRIPTION OF A PREFERRED EMBODIMENT

Figure 1:
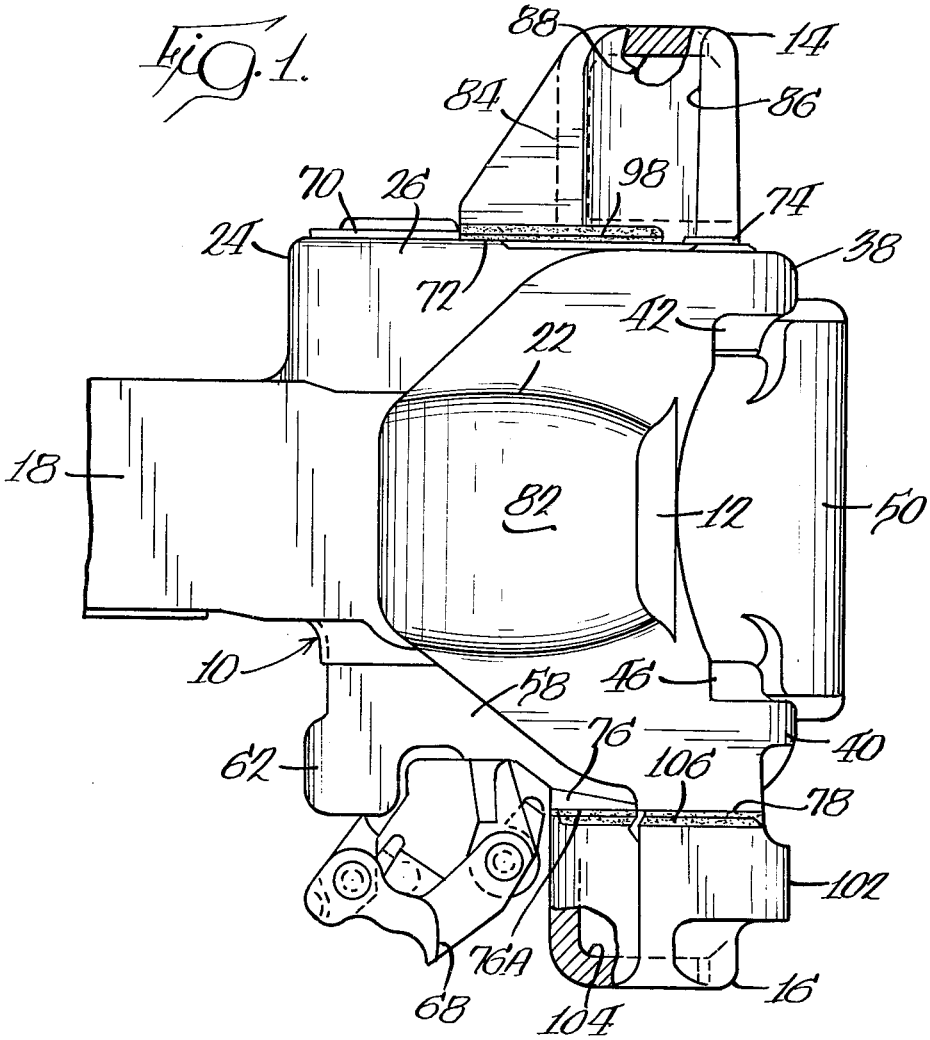
FIG. 1 is a knuckle side view in elevation of a coupler with a top and bottom shelf in accordance with principles of the present invention and showing fragmentary portions of the top and bottom shelves in cross-section.

Referring now to the drawings wherein like reference characters in the several views indicate similar parts a coupler assembly 10 is shown for use on a railway car and particularly on a railway tank car carrying hazardous material. The coupler assembly 10 includes a modified "E" coupler 12 having secured thereto a top safety shelf 14 and a bottom safety shelf 16.

Much of the modified coupler 12 is conventional and common to the standard AAR type "E" coupler. For example, an elongated shank 18 extends rearwardly toward the railway car and is integral with a guard arm 20 and a knuckle tail wall 22. Extending above the shank 18 and located between the guard arm 20 and knuckle tail wall 22, is a horn 24 with a lock chamber 26 having a rearward lock rib 28 defining a top lock lift hole 30. The guard arm 20 has a guard arm nose 32 and a guard arm face 34 defining a lock wall 36. The guard arm face 34 is adjacent a front face 37 of the modified coupler 12.

Referring to the knuckle side 82 of coupler 12, knuckle tail wall 22 is connected to an upper pivot lug 38 and a lower pivot lug 40. Extending downward from the upper pivot lug 38 is an upper pin protector 42 which defines an upper pivot pin hole 44. A lower pin protector 46 extends upward from the lower pivot lug 40 and defines a lower pivot pin hole 48. Pivot pin holes 44 and 48 receive a vertical knuckle pivot pin (not shown) for connecting a coupler knuckle 50. Coupler knuckle 50 has a pulling face 52 which faces the guard arm face 34 and the railway car. The coupler knuckle 50 further defines a flag hole 54 and a forward face 56 opposite the pulling face 52.

Beneath the shank 18 is a lock hole wall 58 defining a lock hole 60. A rotary shaft wall 62 is connected to the lock hole wall 58 and is adjacent a rotary shaft 63. The bottom walls of coupler 12 define a drain hole 64 and a thrower hole 66. An articulated lock lift assembly 68 is connected to the bottom of the coupler 12.

Figure 3:
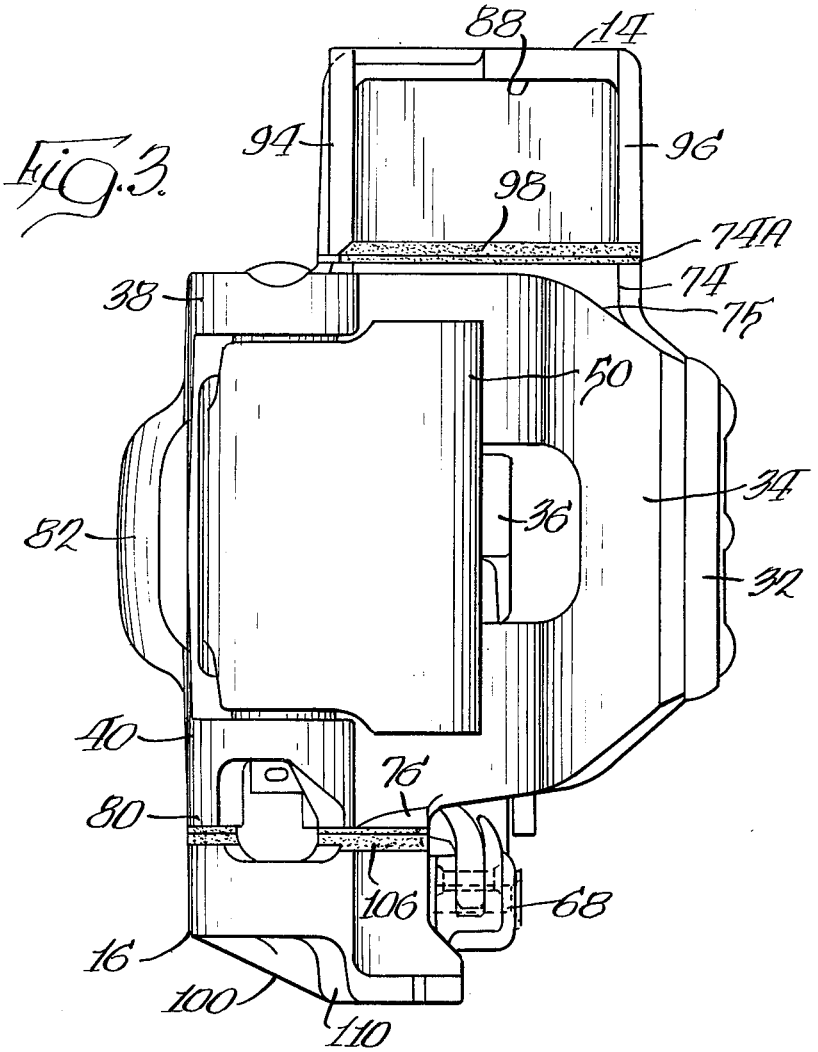
FIG. 3 is a front view in elevation of FIG. 1.

A rearward lock rib 70 (see drawing) extends from the top of coupler 12 and is disposed adjacent a flat rearward surface 72. The improved structure of the modified coupler 12 includes an upper-shelf rib 74 defining a flat front top surface 74A positioned in coplanar relationship with the flat rearward surface 72 for receiving the top shelf 14. The upper-shelf rib 74 is formed with a contoured lower surface substantially complementary to the contoured surface 75 of the coupler casting. The improved structure of modified coupler 12 further includes a lower-shelf rib 76 defining a flat rearward bottom surface 76A positioned in coplanar relationship with a forward flat bottom section 78 for receiving the bottom shelf 16. As best shown in FIG. 3, the lower-shelf rib 76 includes a knuckle-side extension or section 80 extending downward from the lower pivot lug 40 and positioned on the knuckle side 82 of the modified coupler 12.

Figure 2:
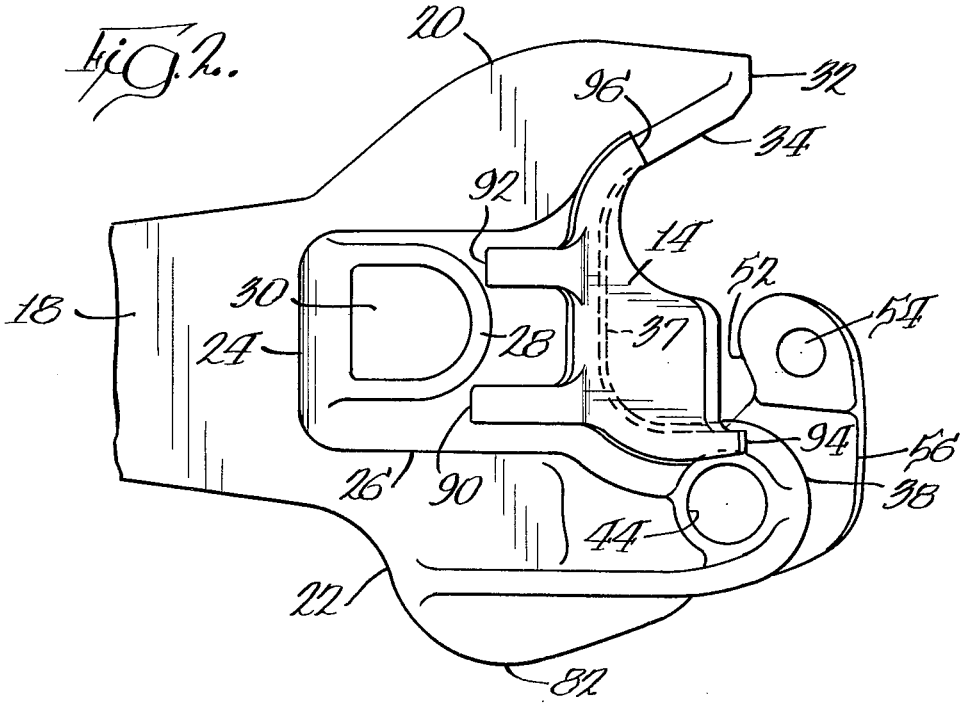
FIG. 2 is a top plan view of FIG. 1.

The top shelf 14 has rearward wall 84 positioned opposite a forward wall having a forward abutment surface 86. The top shelf 14 is shaped to define a top hood covering the flat rearward surface 72 and the upper-shelf rib 74 of the modified coupler 12 and extends forward and above the front face 37 of the coupler without contacting the pulling face 52 of the coupler knuckle 50. The top shelf 14 includes an upper wall defining an upper abutment surface 88 which prevents a mating coupler (not shown) from riding up and over the modified coupler 12 and puncturing a tank car which may be carrying hazardous material. During normal usage, the upper abutment surface 88 will not usually come in contact with the mating coupler and serves merely as a safety structure for preventing accidents and possible derailments. In the illustrative embodiment, the upper abutment surface 88 is positioned a predetermined distance, above the upper shelf rib 74 of coupler 12. Extending rearward from the top shelf 14 is a rearward knuckle rib 90 and a rearward guard arm rib 92, as best shown in FIG. 2. Connected to the rearward knuckle rib 90 is a front knuckle rib 94. Connected to the rearward guard arm rib 92 is a front guard arm rib 96. The top shelf 14 is secured to the modified coupler 12 by welding the bottom of the top shelf at weld positions 98 to the flat rearward surface 72 and the upper-shelf rib 74 of the coupler.

Figure 4:
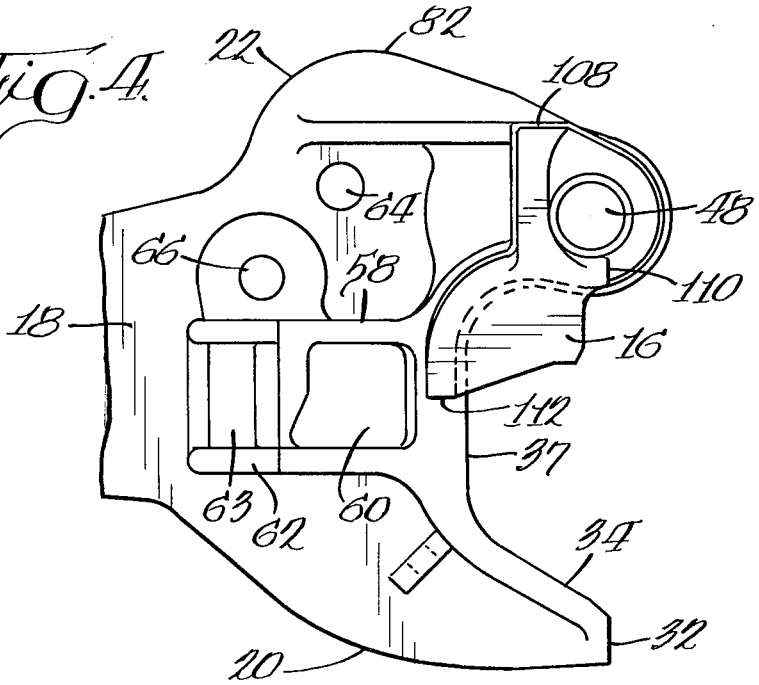
FIG. 4 is a bottom plan view of FIG. 1.

The bottom shelf 16 has a tapered bottom section 100 and a front lower-shelf pivot-lug face 102. The bottom shelf is shaped to define a bottom hood covering the lower-shelf rib 76 of the modified coupler 12 and extending forward and below the front face 37 of the coupler. A lower abutment surface 104 is a safety feature designed to hold the mating coupler in the event the mating coupler fails. During normal usage, the lower abutment surface will not normally come in contact with the mating coupler, but merely serves as a safety feature to prevent accidents and possible derailments. In the illustrative embodiment, the lower abutment surface 104 is positioned a predetermined distance, below the modified coupler 12. The bottom shelf 16 is secured to the bottom of the coupler 12 by welding the bottom shelf along lower weld positions 106 to the lower-shelf rib 76 of the coupler. As best shown in FIG. 4, the bottom shelf 16 further includes a knuckle rib 108 positioned between a front rib 110 and a guard arm rib 112.

Figure 5:
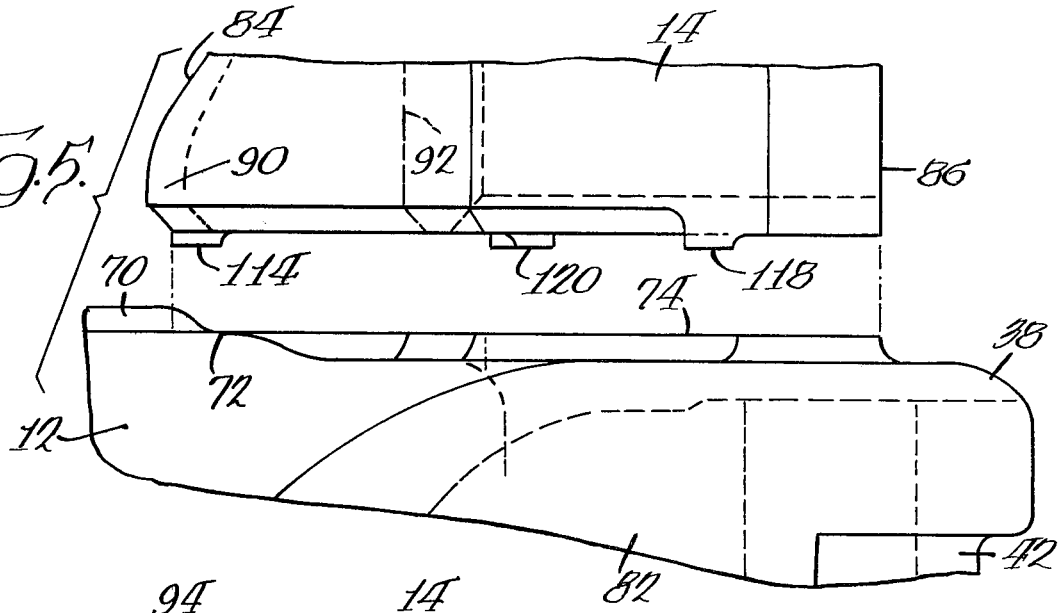
FIG. 5 is an enlarged exploded knuckle side view of a fragmentary section of the top shelf with a set of coupler-engaging pads and a fragmentary section of the coupler with a top surface rib.
Figure 6:
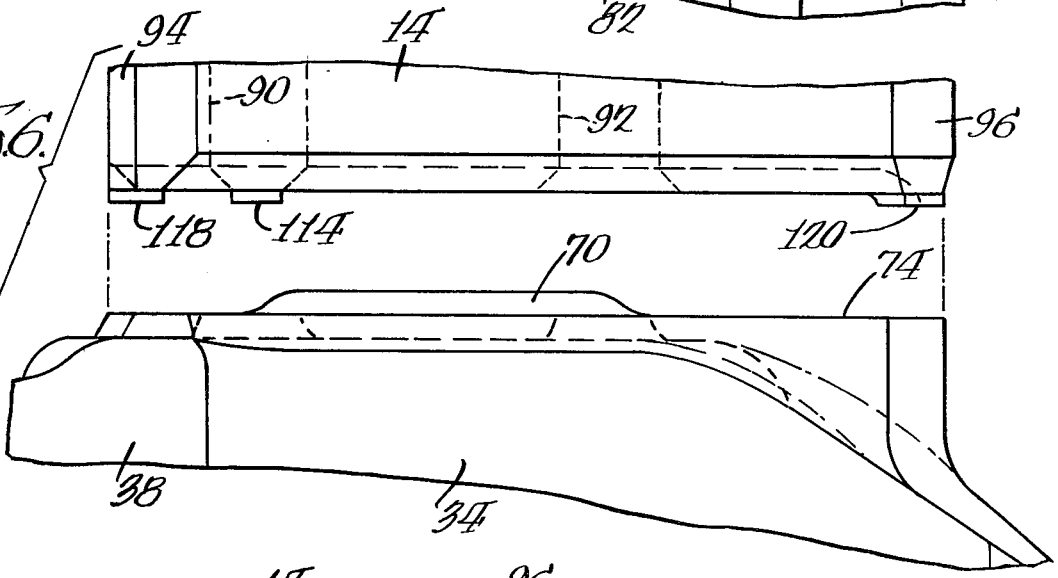
FIG. 6 is a front view in elevation of FIG. 5.
Figure 7:
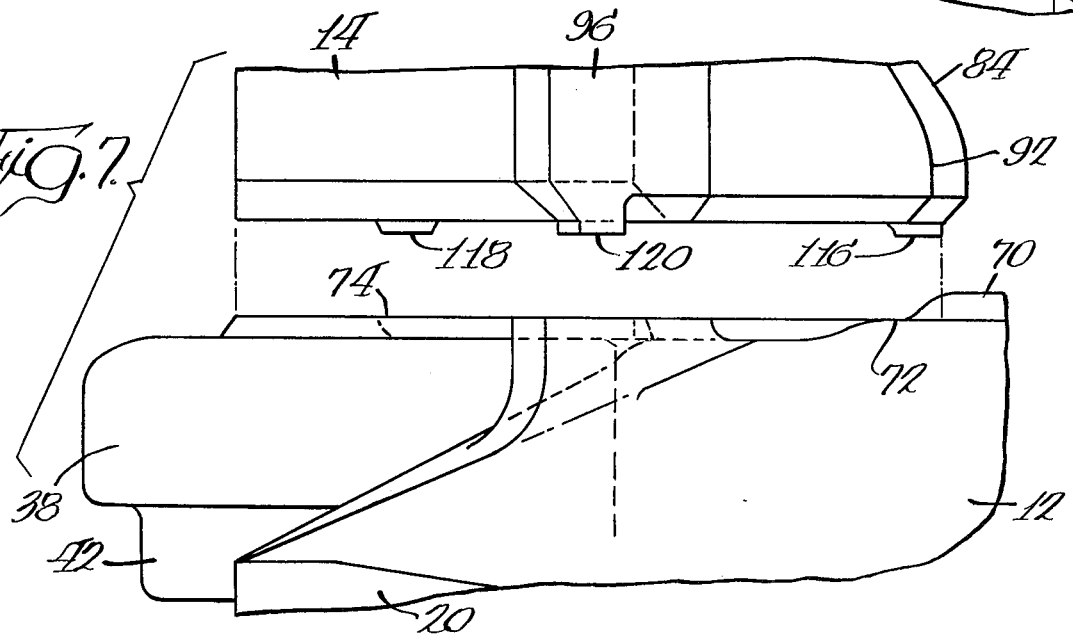
FIG. 7 is a guard arm side view in elevation of FIG. 5.

Referring to FIGS. 5–7, the rearward knuckle rib 90 of the top shelf 14 has a downwardly-extending rearward-knuckle pad 114. The rearward guard-arm rib 92 has a downwardly-extending rearward guard arm pad 116. A front knuckle pad 118 extends downward from the front knuckle rib 94 and a front guard arm pad 120 extends downward from the front guard arm rib 96. Each of the pads have chamfered vertical side walls and together form a set of pads with flat bottom surfaces positioned in coplanar relationship to each other for seating upon the flat rearward surface 72 and the upper-shelf rib 74 of the modified coupler 12. In the illustrative embodiment, each of the pads protrude about one-eighth inch beneath the bottom of the top shelf 14.

Figure 8:
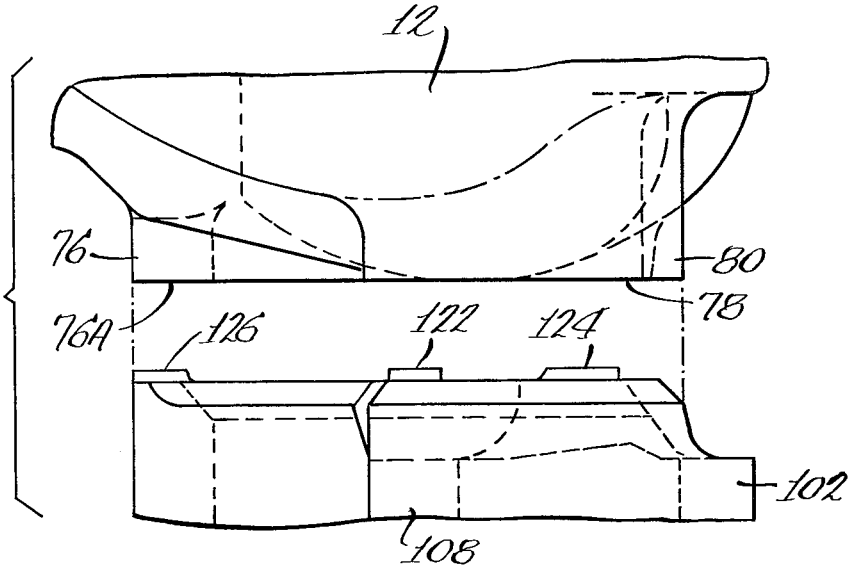
FIG. 8 is an enlarged exploded knuckle side view of a fragmentary section of the bottom shelf with a set of coupler-engaging pads and a fragmentary section of the coupler with a bottom surface rib.
Figure 9:
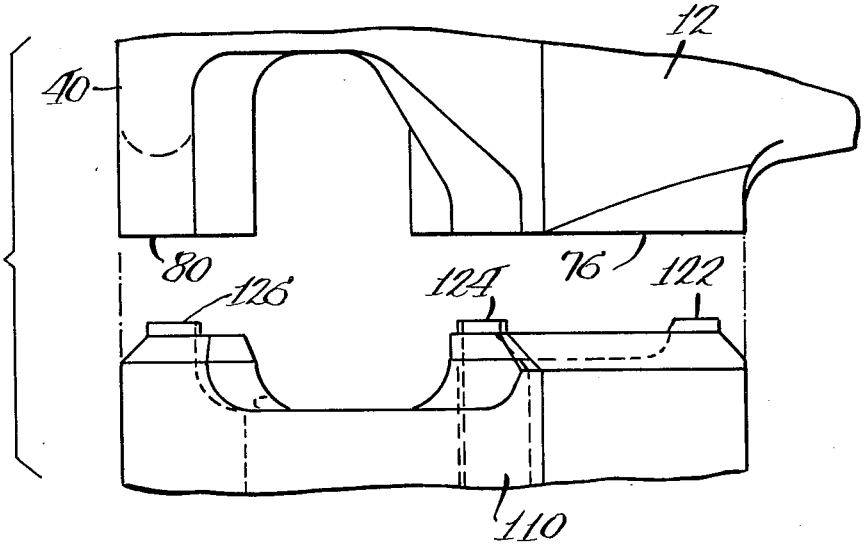
FIG. 9 is a front view of the enlarged portion of FIG. 8.
Figure 10:
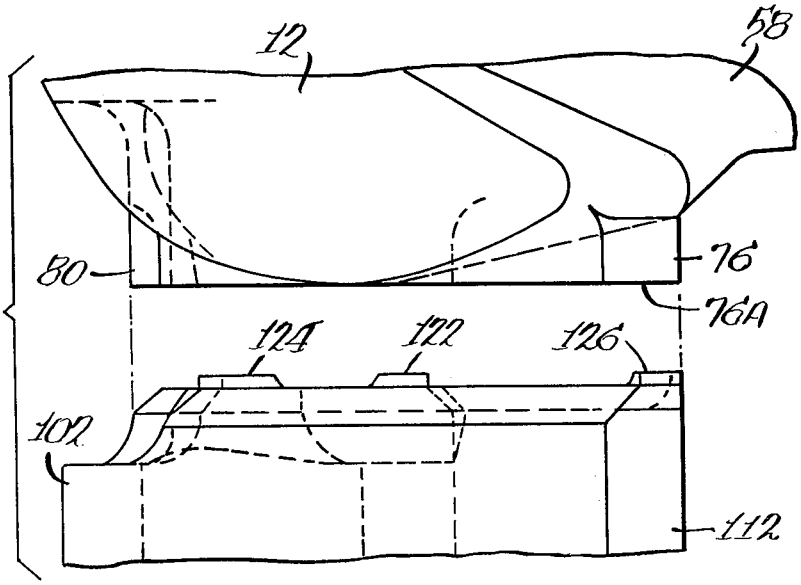
FIG. 10 is a guard arm side view of the enlarged portion of FIG. 8.

Referring to FIGS. 8–10, the knuckle rib 108 of the bottom shelf 16 has an upwardly-extending knuckle pad 122 and the front rib 110 has an upwardly-extending front pad 121. A guard arm pad 126 extends upward from the guard arm rib 112. The upwardly-extending pads form a second set of pads with flat top surfaces positioned in coplanar relationship to each other for abutting the lower shelf rib 76 of the modified coupler 12. In the illustrative embodiment, each of the flanges extends about one-eighth inch above the bottom shelf 16.

In operation, the second coupler is permitted to move along a vertical path between the upper abutment surface 88 and the lower abutment surface 104 when positioned in interlocking engagement with the modified "E" coupler 12.

My improved coupler assembly 10 is particularly useful for tank cars carrying hazardous materials, such as highly flammable material or pressurized combustible gas, and may be used for other types of railway cars. For usage other than with tank cars carrying hazardous material, it may be desirable to use the modified coupler 12 without the top and bottom shelves 14 and 16. For some railway usage, the modified coupler may have the top shelf fixedly secured thereto with the bottom shelf omitted. Alternatively, the modified coupler may have the bottom shelf secured thereto with the top shelf omitted.

It will be apparent that this invention advantageously provides an improved "E" type coupler to which top and/or bottom shelves may be easily attached. By modifying the contour of the coupler head in the manner indicated top and/or bottom shelves may be easily added either at the time of original manufacture or some time subsequently. The design of the top and bottom shelves is itself simplified and the difficult matching of contours on the coupler head and shelves is eliminated.

It will be appreciated that numerous changes and modifications can be made to the embodiment shown herein without departing from the spirit and scope of this invention.

What is claimed is:

1. A railway coupler assembly including a top hooded shelf member for limiting vertical movement of a second coupler in engagement therewith, the improvement comprising, in combination, a Type E coupler having an irregularly contoured upper surface including a horizontal flat rearward upper surface and an irregular sloping forward upper surface, said Type E coupler being modified by having front upper rib means added to the top of the coupler to modify the irregular contour thereof at the location of the top shelf, said upper rib means defining a horizontal planar coupler top surface which is coplanar with said flat rearward upper surface, a hooded top shelf formed with a plurality of downwardly projecting top shelf pads formed on the underside thereof, said top shelf pads having flat coplanar bottom surfaces, said top shelf being positioned with certain of said pads seated against said horizontal planar coupler top surface defined by said upper rib means and at least one other of said pads being seated against said flat rearward upper surface of said coupler, and said top shelf being welded to said coupler top surface.

2. A railway coupler assembly as defined in claim 1 where at least three downwardly projecting pads are formed on the underside of said top shelf in substantially spaced relation to one another.

3. A railway coupler assembly as defined in claim 1 where said top shelf comprises a rearward knuckle rib having a first pad formed thereon, a rear guard arm rib having a second pad formed thereon, a front knuckle rib having a third pad formed thereon and a front guard arm rib having a fourth pad formed thereon, said top shelf pads projecting downwardly from the underside of said top shelf and having flat bottom surfaces which are coplanar for seating against said coupler top surface.

4. A railway coupler assembly as defined in claim 3 where the pads formed on said top shelf project downwardly approximately one-eighth inch from the underside thereof.

* * * * *